US005986563A

United States Patent [19]

Shapiro

[11] Patent Number: 5,986,563

[45] Date of Patent: Nov. 16, 1999

[54] DIGITALLY PROGRAMMABLE PROTECTING MEANS AND A KEY FOR MECHANICAL ROTARY LOCKING DEVICES

[76] Inventor: Solomon Shapiro, 80 Antibes Dr., Unit 805, Willowdale, Ontario, Canada, M2R 3N5

[21] Appl. No.: 08/821,426

[22] Filed: Mar. 21, 1997

[51] Int. Cl.[6] ..... H04O 1/00

[52] U.S. Cl. ..... 340/825.31; 340/825.34; 340/825.3; 70/278; 70/277; 70/409; 70/427; 235/382

[58] Field of Search ..... 340/825.31, 825.34, 340/825.3; 70/277, 278, 9, 409, 427; 235/382, 444, 492

[56] References Cited

U.S. PATENT DOCUMENTS 4,200,227 4/1980 Lemelson ..... 235/382
4,257,030 3/1981 Bruhin et al. ..... 340/825.31
4,326,125 4/1982 Flies ..... 235/443
4,789,859 12/1988 Clarkson et al. ..... 340/825.31
4,833,465 5/1989 Abend et al. ..... 340/825.31
4,854,143 8/1989 Corder et al. ..... 70/218
4,937,437 6/1990 Ferguson ..... 235/382

*Primary Examiner*—William A. Cuchlinski, Jr.
*Assistant Examiner*—Yonel Beaulieu

[57] ABSTRACT

A digitally programmable protecting mechanism and a programmable key for a mechanical rotary lock for providing enhanced protection and enabling user to change mechanical and electronic security code configuration at any time without involving of special tools. The device includes a mechanical digitally configurable key where the protecting binary code configuration is formed by cylindrical binary coding members put on a central core of the key, and an electronic programmable digital module attached to a mechanical rotary lock for capturing the key code configuration, verifying, and releasing the lock if the verification proves that the key coding configuration and the electronic module coding are matched.

11 Claims, 5 Drawing Sheets

DIGITALLY PROGRAMMABLE PROTECTING MEANS AND A KEY FOR MECHANICAL ROTARY LOCKING DEVICES

FIELD OF INVENTION

This invention relates to the technical field of locking devices used to protect accessing to certain objects or areas, and more specifically relates to the types of locking devices containing rotatable operating element operable by a code configured key upon inserting the key in the key way of the rotatable element of said locking device.

BACKGROUND OF THE INVENTION

It is known in the prior art of locking devices a class of inexpensive mechanical rotary locks with rotatable operating elements borne in the lock housing and operated by a key inserted in the key way of the lock. Such locks normally contain internal protecting mechanism which is mechanically set up to a specifically ciphered protective configuration responsively matching mechanical configuration of the associated key. Typically the ciphering configuration of this type of mechanical locking devices is provided by a plurality of few mechanical tumblers within the lock. The protective ciphering property of such a lock is achieved by variations of the tumblers' lengths, which are compensated by the mechanical configuration of the associated key. This kind of locks are commonly used as the door locks, the car ignition locks, the filing cabinet locks, etc. Though widely used, such locks have certain shortcomings due to its fundamentally mechanical nature, which cannot be easily overcome within the known art.

Said shortcomings are:

- relatively limited degree of protecting ability of such locks due to limitation of number of applied tumblers in the lock, and due to the analog nature (rather than digital nature) of the tumblers protecting operation which allows marginal approach to the counterfeiting attempts;
- inability to operatively change protective configuration of the lock and the associated key by the user.

The first aforementioned shortcoming related to the limited protecting security can be overcome without departing from the price range of the lock by retaining the inexpensive rotatable operating element within the lock, but replacing the mechanical tumbler protecting mechanism by a binary programmable digital coding means with electronic verification, providing controllable high security rate for the protective mechanism.

The shortcoming related to immutability of the mechanical rotary lock can be overcome within the field of digital technology by applying binary bit oriented changeable key coding members.

There are obvious advantages in application of the low cost mechanical locking devices with digitally configured electronically controlled protective means and the digitally mechanically configurable key. They are:

- substantial increasing of protective security rate of the locking devices due to digital nature of protective coding;
- significant increasing of protective capability of the lock application due to possibility of changing the digital protective configuration of the lock and the key by the user when needed, and as frequent as needed;
- eliminating necessity of changing the lock when the owner of the installed lock is changed, which is achieved by the lock reconfiguring procedure;

- allowing controlled access to the same locking device at different time with plurality of differently configured keys by changing at different time the lock coding configuration, matching the differently configured keys.

However, in spite of all the aforementioned teachings, a void currently exists within the technology of mechanical rotary locks that provides for the producing of inexpensive digitally coded rotary locks with enhanced protective capability and with the ability to be configured and reconfigured by the user.

It is therefore an object of this invention to provide a digitally programmable protecting mechanism for mechanical rotary locking devices which will render controllable and very high level of protecting security;

- It is a further object of this invention to provide a digitally programmable protecting means for mechanical rotary locking devices that will allow easy changing its protective coding configuration by the user;
- It is a further object of this invention to provide such a digital protecting means that is easy to install and maintain;
- It is still a further object of this invention to provide a key, associated with such a protecting means for locking devices, that can be easily configured and reconfigured by the user.

It is further object of this invention to provide digital protecting means and a digital key for mechanical rotary locking devices that will be inexpensive and suitable for mass production.

Further and other objects of this invention will become apparent to a person skilled in the art when considering the following summary of the invention and the more detailed embodiments of the invention illustrated herein.

SUMMARY OF THE INVENTION

The digitally programmable protecting means and a key for the mechanical rotary locking devices of this invention is particularly characterized by application of digital binary coding technique for configuring protective elements responsible for security features of the locking device, which ultimately delivers the locking system with considerably enhanced rate of protecting security, and provides for the user capability to control changeable protective code configuration. These features, implemented in this invention, help to overcome shortcomings found in prior art systems.

In this connection, the enhanced rate of maximum security, and the user's flexibility of changing protective configuration of the locking devices are highly desirable features for the household application, for auto-vehicle ignition switching and lock systems, for access to the areas with heightened security sensibility, protecting special storage facilities, etc.

The invention incorporates a binary coded electrical digital protective means for the mechanical rotary locking device and an associated digitally binary coded mechanical rotatable key.

The digitally coded protecting means includes a housing with a key way rotatably born in the housing, the key way longitudinally exposed to a code sensing means through a communicating window, cut in said housing.

A key operated revolving latchable mechanism operationally connected with the locking device is installed on the housing, along with an electromechanical latching means, for instance a solenoid, having its operable mechanical member, for instance a core plunger, communicable with said latchable means in the way of either latching or releasing the latchable means. The electromechanical latching means receives energizing electrical signals from an electrical decoding means, comparing the parallel digital binary code, received from the key, with the internally preset binary security code pattern, and generating the unlatching electrical signal to said latching means only if the cods are found identical, otherwise freezing the protective means in the latched state for predetermined short period of time.

The key, associated with the digitally coded lock protecting means, contains a plurality of code bit members, representing bits of the binary key code configuration, which is captured by a code sensing means.

The electrical type of the code sensing means contains plurality of electrical contacts exposed to the key way through said communicating window in the housing for communicating with the key code bit members. The code bit members are fabricated from two sorts of material: electrically conductive material for representing a bit binary state "0", or from insulating material for representing a bit binary state "1". The contacts are electrically pulled up to positive polarity of the power supply, and touching of the sensing contact by the electrically conductive code bit member pulls polarity of the sensing contact doen to neutral, designating bit binary state "0", whereas electrically insulating code bit member lives positive polarity of the sensing contact unchanged, designating bit binary state "1".

According to another aspect of the invention a mechanical type of the code sensing means is employed, containing plurality of push-button electrical switches and plurality of switch actuating bit sensing rods, exposed to the key way through tunnels born in the housing for communicating with the key code bit members. The key code bit members are assorted in two sizes of their outer diameters, where the code bit member with bigger diameter, being positioned against the bit sensing rode will push the rode, actuating the switch, producing bit binary state "0". The code bit member with smaller diameter, being positioned against the sensing rode will not reach and affect position of the bit sensing rode, living the switch not actuated, which produces bit binary state "1".

The digital parallel binary code, reflecting the code configuration of the inserted key, sensed by the code sensing means and is passed to an electrical decoding means.

In a preferred embodiment the electrical decoding means serves for verifying legitimacy of the code received from the code sensing means, and for operating the electromechanical latching means. It comprises a plurality of setting means for setting binary security code pattern; a plurality of Exclusive NOR logic gates (EXNOR) for comparing the cod received from the code sensing means with the preset security code pattern; an AND logic gate for evaluating the result of the cods comparison; a switching transistor for energizing a lock latching means, releasing the locking device from latching state for operation, when the compared codes are found identical; a time delay circuit, consisting of a charge storing capacitor and a discharging resistor; a charging invertor for charging the charge storing capacitor when the code received from the code sensing means is not identical to the security code pattern; a feedback invertor for disabling the electrical decoding means for the period of time delay, defined by the time delay circuit.

A power supply provides power to the decoding means, having its primary voltage permanently connected to the electrically decoding means, and having the neutral power bus connected to the circuitry of the decoding means via power dedicated sensing contacts of the code sensing means, which are normally opened, and are being closed exclusively by insertion of a key in the key way, that allows supplying power to the decoding means.

DETAILED DESCRIPTION OF THE PREFERRED EMBODIMENTS

Figure 1A:
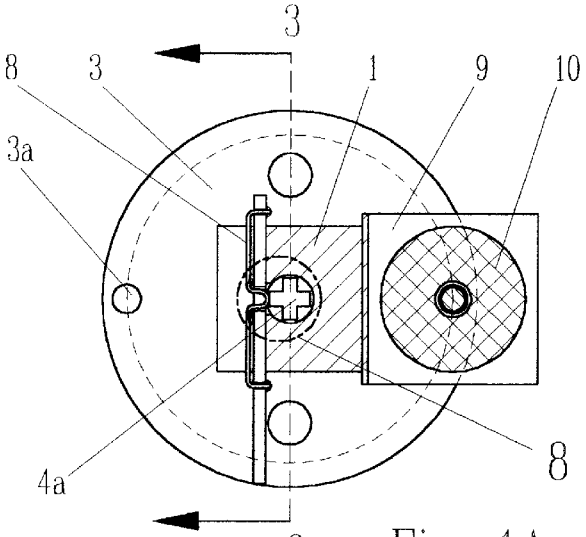
FIG. 1A is a cross-sectional view of the digitally programmable protecting means with electrical type of a key code sensing means, taken along the section 1—1 of FIG. 1.
Figure 1:
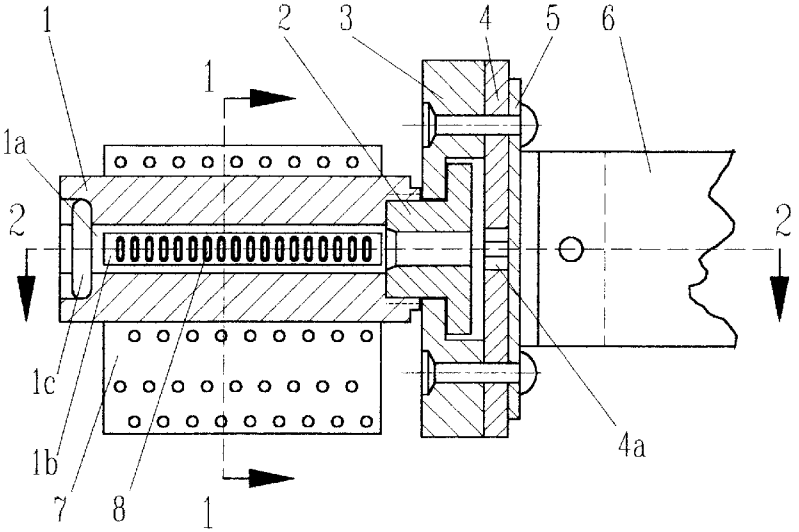
FIG. 1 is a longitudinal sectional view of the digitally programmable protecting means for a mechanical rotary locking device with electrical type of a key code sensing means in a preferred embodiment (section 3—3 of FIG. 1A)
Figure 1B:
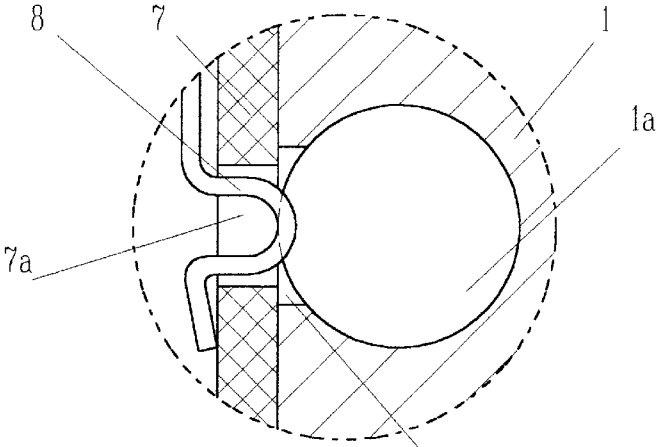
FIG. 1B is a zoomed view of positioning of a binary bit sensing contact with the key way in a preferred embodiment (zoom section 8 of FIG. 1A)

Referring to FIG. 1 a longitudinal section of a digitally programmable protecting means for the mechanical rotary locking device is illustrated in a preferred embodiment utilizing an electrical type of a code sensing means. The protecting means is essentially integrated around a carrying housing 1. A cylindrical longitudinal key way 1*a* is born rotatably in the housing 1 for holding an inserted lock key. Mid portion of one side of the housing 1 is planed off, so the shaved plane of the housing coincides with the wall edge of the cylindrical key way 1*a*, as it is shown on the FIG. 1B. A window 1*b* to the key way 1*a* is cut in the planed off side of the housing symmetrically with reference to the axis of the key way.

A circular groove 1*c* is turned in the key way 1*a*, close to the entry opening, for holding an inserted lock key, when the key is turned inside the key way.

A key code sensing means 7 of electrical type is composed of a plurality of specially shaped springy wires forming binary bit sensing contacts 8, installed on a printed circuit board. The binary bit sensing contacts 8 have U shaped portions protruding into the key way 1*a* through the window 1*b*, when the key code sensing means 7 is installed on the housing 1, as it is shown on the FIG. 1B. The key code sensing means 7 carries plurality of slots 7*a*, each slot accommodates U portion of each binary bit sensing contact 8. When the code sensing means 7 is installed on the housing 1 the binary bit sensing contacts 8 pass through the slots 7*a*, protruding inside the area of the key way 1*a* through the window 1*b*.

Referring to the same FIG. 1, a supporting bush 2, rotatably carrying a latchable plate 3, is fixedly installed on the butt-end of the housing 1 on the opposite side of the key entry opening, forming a rotatable assembly, where the latchable plate 3 can rotate on the supporting bush 2 and is aligned with the axis of the cylindrical key way 1*a*. There is at least one operating latching cavity 3*a* on the latchable plate 3. In the preferred embodiment the latchable plate 3 contains two operating latching cavities, situated on diametrically opposite sides of the latchable plate.

Referring to FIG. 1 and FIG. 1A An operating plate 4, containing a cavity 4*a*, profiled to match the shape and size of a lock key tip, is fastened to the latchable plate 3, having its profiled cavity 4*a* rotatably aligned with axis of the key way 1*a*.

A slotted coupling 5 is firmly fastened to the operating plate 4, rotatably aligned with axis of the key way 1*a*.

A lock operating oblong plate 6 has its one end held in the slotted coupling 5, and its another end is supposed to be coupled with the locking device, serving as a lock operating shaft.

When a lock key is inserted in the key way and the key tip enters the profiled cavity 4*a*, then rotation of the key will cause rotation of the operating assembly, including the lock operating plate 6, if the latchable plate 3 is not latched.

Figure 2A:
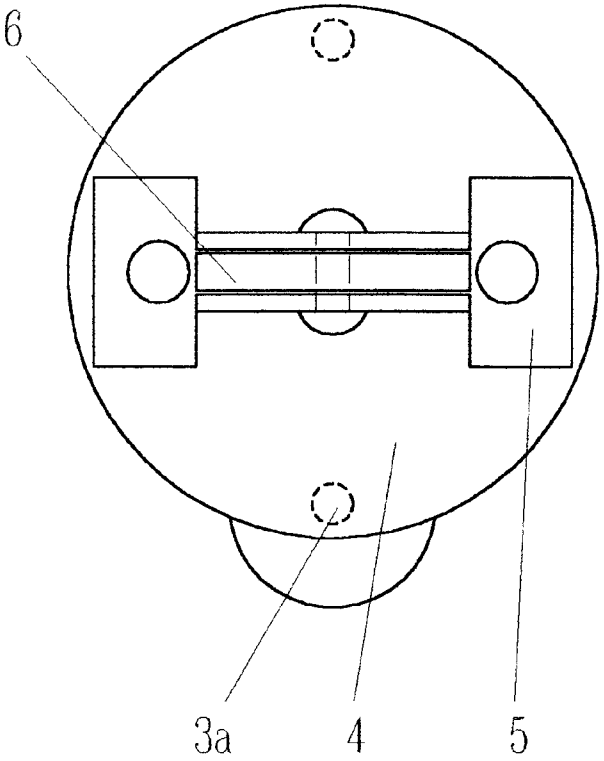
FIG. 2A is a lateral elevation of the digitally programmable protecting means shown according to the direction 4—4 of FIG. 2.
Figure 2:
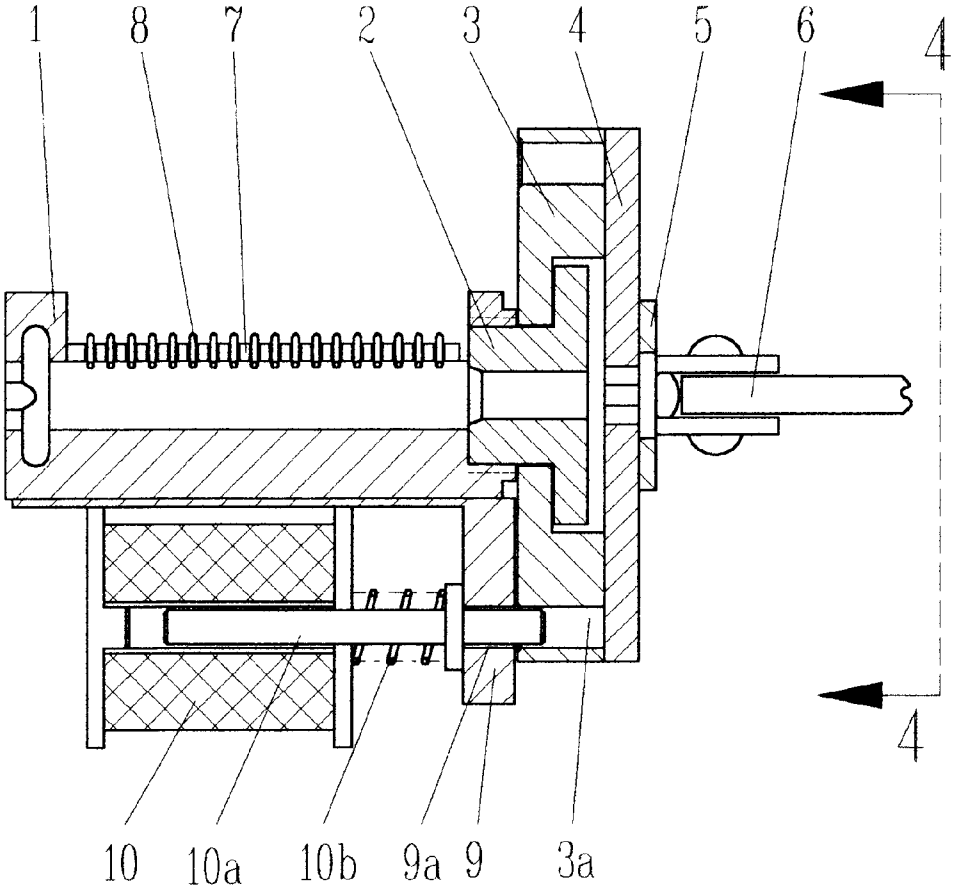
FIG. 2 is a plan sectional view of the digitally programmable protecting means, taken along the section 2—2 of FIG. 1.

Referring to FIG. 2, a latching bracket 9, containing a fixed latching hole 9*a*, is installed on the housing 1 having the fixed latching hole 9*a* coinciding with the operating latching hole 3*a* of the latchable plate 3, when the latchable plate 3 is correspondingly rotatably positioned.

An electromechanical latching means, which is a solenoid 10 is installed on the housing 1, within the latching bracket 9 having its plunger 10*a* inserted in the fixed latching hole 9*a* of the latching bracket 9. A spring 10*b* provides pressure to the plunger 10*a* in the direction of the latchable plate 3, so when the operating latching hole 3*a* of the latchable plate is positioned across the fixed latching hole 9*a*, the tip of the plunger 10*a* enters the operating latching hole 3*a* through the fixed latching hole 9*a*, latching the latchable plate 3 in this position, and causing the whole operating assembly to be in the latched state.

In order to release the operating assembly from the latched state the solenoid 10 has to be electrically energized. This causes the plunger 10*a* to be pulled from the operating latching hole 3*a* into the solenoid, and the latchable plate 3 will be released, allowing operating of the locking device.

Figure 3:
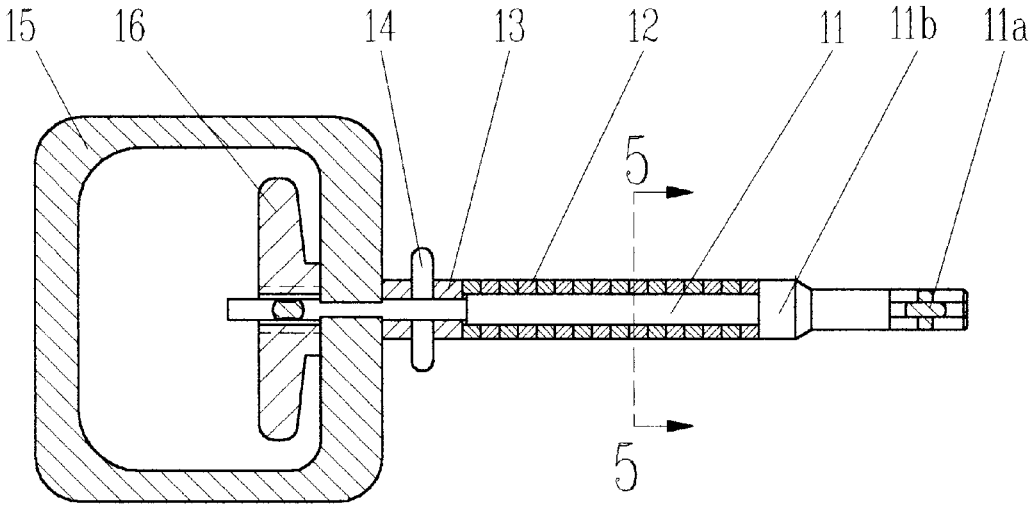
FIG. 3 is a longitudinal sectional view of the binary coded configurable key in a preferred embodiment.
Figure 3A:
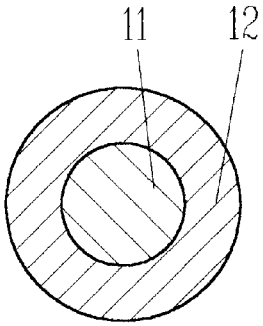
FIG. 3A is a cross-sectional view of a key shaft showing a central key core with a bit coding member according to FIG. 3, taken along the section 5—5.

Referring to FIG. 3 and FIG. 3A, the lock key is formed as a cylindrical body around a central key core 11. The key core 11 may have cross-section of any shape, particularly the key core cross-section may be round as in the preferred embodiment shown on FIG. 3*a*. The key core 11 has a tip 11*a*, profiled to match the size and shape of the profiled cavity 4*a* of the operating plate 4, where this tip is to be inserted. Close to the tip of the key core 11 there is a cylindrical hub 11*b* with the cone-shaped front end. Diameter of the hub matches diameter of the key way 1*a*, so the lock key can be freely inserted in the key way. Length of the cylindrical portion of the hub 11*b* is such, that upon complete insertion of the lock key in the key way 1*a*, the hub 11*b* will cover and touch at least one binary bit sensing contact 8, which is considered to be a power dedicated contact. In the preferred embodiment the hub 11*b* overlaps two power dedicated sensing contacts.

The opposite end of the key core 11 is threaded and longitudinally grooved in order to be firmly fixed in a key handle 15.

Referring to the same FIG. 3, a plurality of cylindrical binary bit coding members 12 are threaded on the central core 11. Outer diameters of the binary bit coding members are equal to diameter of the core hub 11*b*. Cylindrical heights of the binary bit coding members 12 are equal to the distance between the binary bit sensing contacts 8 of the key code sensing means 7. The binary state of each binary bit coding member 12 is defined by the electrical property of material of which the bit coding member is fabricated. Namely in the preferred embodiment, electrically conductive material will be sensed by the key code sensing means as binary state "0", and electrically insulating material of the binary bit coding members will be sensed as binary state "1".

A spacing bushing 13 is put on the central core 11 for providing a clearance between the coded area of the lock key and a key handle. The spacing bushing 13 has its inner opening shaped to match longitudinal grooving of the core 11. The outer diameter of the bushing is equal to diameter of the core hub 11*b*.

A key holding pin 14 is firmly fixed in the spacing bushing 13 for holding the key in the holding groove 1*c* of the housing 1, when the inserted key is being turned. In the described preferred embodiment two holding pins are employed.

A key handle 15 having a fastening opening, shaped to match longitudinal groove of the core 11, is fixedly put on the key core 11.

A tightening screw 16 is screwed on the tail of the core 11 for tightening the handle 15 to the key assembly.

Figure 4:
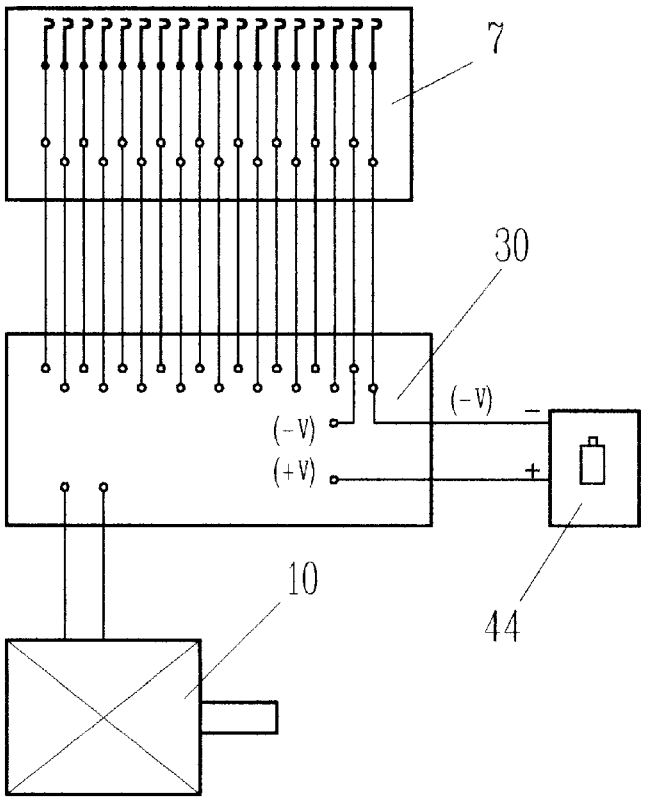
FIG. 4 is a functional block diagram of main operating electrical blocks in a preferred embodiment.

Referring to FIG. 4 the functional principles of capturing and verifying of the key code, and operating of an electromechanical latching means is illustrated in form of a block diagram. The block diagram includes a code sensing means 7, a code decoding means 30, a power supply means 44 and an electromechanical latching means 10.

Referring to FIG. 4 the power supply 44 has its positive power bus (+V) permanently connected to the decoding means 30, and its neutral bus (−V) is being connected to the decoding means 30 through the normally opened power dedicated sensing contacts of the code sensing means 7, keeping the decoding means 30 and electromechanical latching means 10 disconnected from the power supply 44, causing the protective means to be in the latched state. Insertion of the lock key in the key way 1*a* of the housing 1, causes closing of these power dedicated contacts by the key core hub 11*b*, energizing the decoding means 30.

In another aspect of the invention, energizing of the decoding means 30 can be also achieved by electrical connecting of the neutral bus of the power supply 44 to the housing 1, considering that the housing is fabricated of the electrically conductive material. In such case it is enough if the key core hub 11*b*, being in electrical contact with the housing 1, will touch only one power dedicated sensing contact, which is connected to the neutral bus (−V) of the decoding means 30. The electrical connection of the neutral polarity between the power supply 44 and the decoding means 30 will occur via electrically conductive housing 1.

The bit sensing contacts of the code sensing means 7 are engaged in direct pressure contact with the lock key bit coding members, stimulating electric potentials, reflective the parallel binary code at which the key is configured.

The code, captured from the lock key, is being passed in parallel form to the code decoding means 30, and undergo verification by being compared with the security code pattern, preset in the decoding means 30. If the received code matches the security code pattern, the decoding means 30 energizes the electromechanical latching means 10, for instance a solenoid, releasing the locking device protective means from the latched state. In case if the received code does not match the security code pattern, the electromechanical latching means 10 will not be energized, living the locking device protecting means in the latched state, and the decoding means 30 will freeze the locking device protective means in the latched state for predetermined short period of time.

Figure 5:
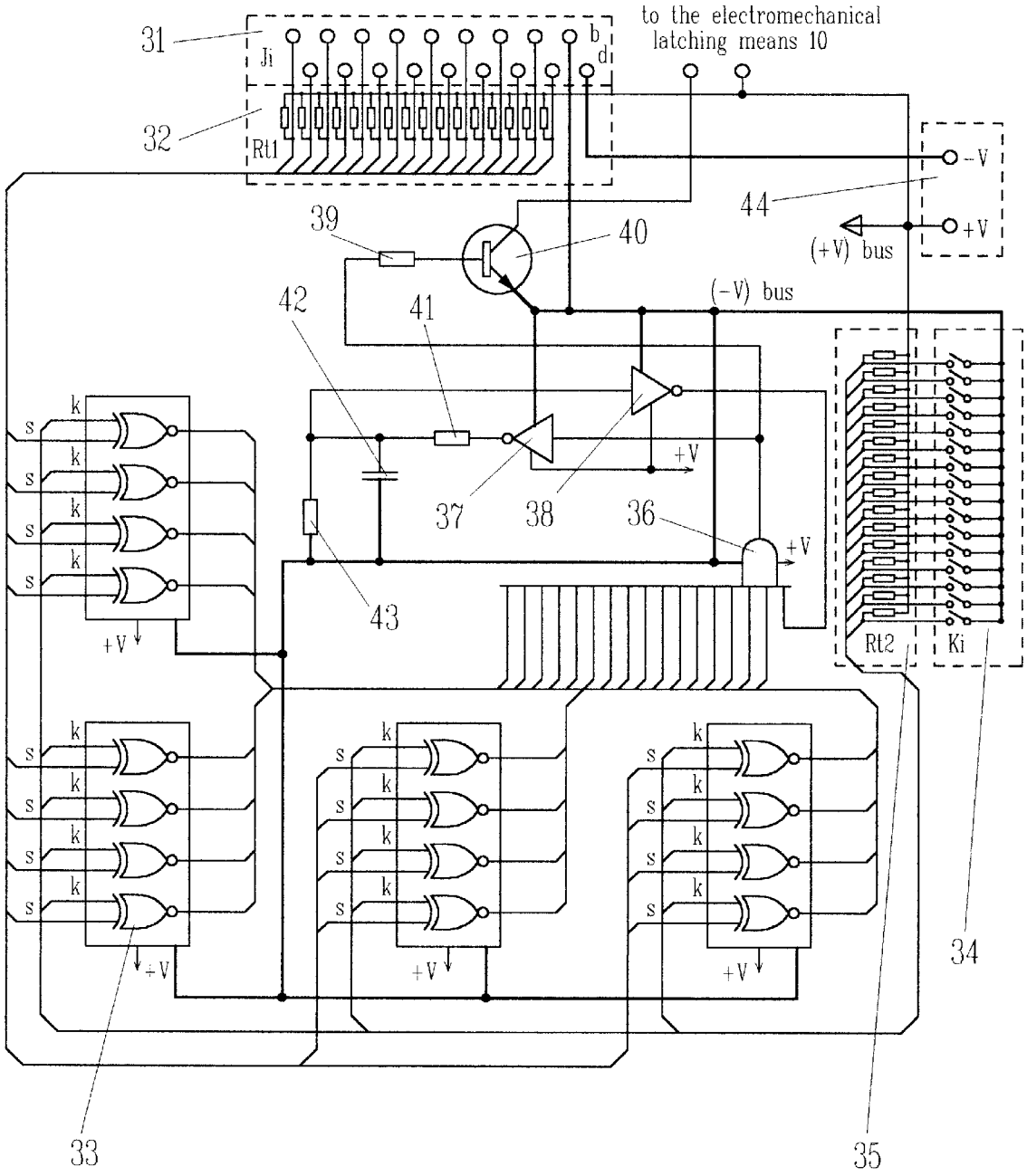
FIG. 5 is an elevational logic diagram of a key code decoding means in a preferred embodiment.

Referring to FIG. 5, the preferred embodiment of the key code decoding means 30, is illustrated in form of an electrical logic diagram. The code decoding means 30, disclosed in this invention, includes a plurality of parallel code receiving means, which are pads 31, a plurality of Exclusive NOR (EXNOR) logic gates 33, a plurality of first set of pull up resistors 32 and a plurality of second set of pull up resistors 35, a plurality of security code pattern setting means 34, an AND logic gate 36, a charging logic gate 37, a feedback logic gate 38, a current limiting resistor 39, a switching semiconductor means, which is transistor 40, a charging resistor 41, a charge holding capacitor 42, a discharging resistor 43, and a power supply 44.

All electrically active components illustrated in the preferred embodiment are implied to be of an active positive polarity (+V) with reference to neutral (−V) common power bus.

Referring to FIG. 5, the power inputs of all active logic devices, employed in the decoding means 30, are permanently connected to the positive polarity output (+V) of the power supply 44. Common neutral poles of all active devices are joint to the common (−V) bus and connected to a power dedicated pad b of the code receiving pads plurality 31. In the preferred embodiment a neutral output (−V) of the power supply 44 is connected to a power dedicated pad d of the receiving pads 31, and as long as the pads b and d are not interconnected no electric power is supplied to the decoding means 30. The pads b and d are connected by the external wires to two power dedicated sensing contacts 8 on the code sensing means 7. These two contacts are the last in the row of the sensing contacts and are positioned in the furthest part of the key way 1*a*. These contacts will be the last two sensing contacts reached by the inserted lock key, and will be interconnected by the metal hub 11*b* of the key. It will cause connecting of the power supply 44 to the code decoding means 30, and the metal core 11 of the key will assume neutral polarity (−V) of the power supply 44.

It is important concept of this invention that electrical power is applied to the decoding means 30 only when the key is inserted in the key way, which provides the best power conservation condition, favorable for employing batteries as the power source for the locking device protecting means.

Other pads of the plurality of pads 31, connected by external wires to the rest of sensing contacts 8 of the code sensing means 7, are connected to s inputs of the EXNOR gates of the plurality of EXNOR gates 33. All s inputs of the EXNOR gates are pulled up to (+V) potential of the power supply 44 through first set of pull up resistors of the plurality 32. When the lock key is completely inserted in the key way, the bit coding members 12 of the key will press the code sensing contacts 8 of the code sensing means 7. The non-conductive bit coding members will not change pulled up positive polarity of the s inputs of the EXNOR gates. The conductive bit members 12 will pull down s inputs of the EXNOR gates to (−V) neutral potential through the key core 11 connected to neutral power bus. As a result, the polarity of the s inputs of the EXNOR gates will reflect image of the binary code configuration of the lock key.

Inputs k of the EXNOR gates plurality 33 are connected to the plurality of the security code pattern setting means 34, and to second set of pull up resistors of the plurality 35. The security code pattern setting means can be either fixed configuring wire jumpers, or a set of switches for providing variable code pattern setting. The security code pattern setting means of the plurality 34 have common connection to the neutral power bus (−V). When the setting means of the plurality 34 are opened the k inputs of the EXNOR gates will have positive polarity (+V), due to the pull up resistors of the plurality 35. Closing contacts of the code setting means 34 brings the k input of the EXNOR gate to neutral (−V) potential. As a result, the state of polarity of the k inputs of the EXNOR gates will reflect the protective security code pattern.

According to the Boolean principles of function of the EXNOR gates, the s and k inputs of the EXNOR gates will produce voltage on the output of the gate as follows:

- if the k and s inputs are equal—the output of the EXNOR gate will produce binary "1" output, which will be positive voltage (+V);
- if the k and s inputs are different—the output of the EXNOR gate will produce binary "0" output, which will be neutral voltage (−V).

Outputs from all EXNOR gates of the plurality 33 are connected to inputs of the AND gate 36. One more input of the AND gate 36 is connected to output of the feedback invertor 38. According to the Boolean principles the AND gate produces binary "1" output, which is positive voltage (+V), when all its inputs are at the binary state "1", otherwise the AND gate will produce binary "0" output, which is neutral voltage (−V).

If all bits of the parallel binary code received from the code sensing means 7 are equal to the corresponding bits of the security code pattern set by the code pattern setting means of the plurality 34, then all inputs of the AND gate 36 will be positive, and the AND gate 36 will produce positive voltage on its output. The output of the AND gate 36 is connected through the current limiting resistor 39 to base of the switching transistor 40, and to input of the charging invertor 37. The transistor 40 will electrically close the circuit of the latching solenoid 10, energizing the latching solenoid, releasing the protective means of the locking device from the latched state. The charging invertor 37 will produce neutral potential on its output, keeping the charging capacitor 42 in the discharged state. The feedback invertor 38, having neutral potential on its input, will produce positive voltage on its output, that will be applied as binary input "1" to the AND gate 36, sustaining positive voltage on the AND gate output. This is a stable state of the decoding means 30 when the lock key with the correct code is inserted.

If one or more of the EXNOR gates have unequal inputs s and k, which may occur in the case of receiving of incorrect key code, then the corresponding EXNOR gates will produce neutral polarity on their outputs which will go to inputs of the AND gate 36. This will bring output of the AND gate to the neutral state. In this case the switching transistor 40 will not close the solenoid electrical circuit, and the latching solenoid 10 will not be energized, keeping the protecting means in latched state. The charging logic gate 37, having neutral polarity on its input, will produce positive voltage on its output, and the charge holding capacitor 42 will be charged through the charging resistor 41 to the voltage level (+V).

Considering the CMOS semiconductor technology, it is assumed, that for the logic gates the reliable turning ON threshold $P_{on}$ is 0.6 with reference to the power supply voltage +V ($P_{on}$=0.6), and the reliable turning OFF threshold $P_{off}$ is 0.4 ($P_{off}$=0.4).

The charging time $T_c$ of charging the capacitor 42 to the voltage level of the upper threshold $P_{on}$ is defined by the formula:

$$T_c=-R2*C*\ln(1-P_{on}).$$

For illustration: if R2=300 ohm, and C=500 mkf, then $T_c$=0.137 sec.

After elapsing the charging time $T_c$ the feedback invertor 38 will produce neutral potential on its output, which is applied to input of the AND gate 36, sustaining the AND gate output in the neutral voltage state. This is the stable state of the decoding means 30 when failing key with the incorrect code is inserted.

When the failing key is pulled out from the key way, the decoding means 30 will be disconnected from the power supply 44, and the charge storing capacitor 42 will start discharging through the discharging resistor 43, producing post-failure delay time.

The post-failure delay time $T_d$, defined by discharging of the capacitor 42 and discharging resistor 43 to the lower threshold $P_{off}$ is defined by the formula:

$$T_d=-R1*C*\ln(P_{off}).$$

For illustration: if R1=100,000 ohm, and C=500 mkf, then $T_d$=45.8 sec.

During period of the post-failure delay $T_d$, even if the key with correct security code is inserted in the key way 1*a*, the AND gate 36 still will be functionally disabled by presence of the neutral potential on its input from the feedback invertor 38. Only holding the decoding means 30 without applied power for the time $T_d$ or longer will allow the charge holding capacitor 42 to be sufficiently discharged in order to return the decoding means 30 back to functional condition. It means that a lock key must not be operationally inserted in the key way for the period of at least the post-failure delay time $T_d$.

The code protecting security rate can be characterized by the code security protecting time $T_S$, which is the time, required for observing of one half of the possible code combinations, and is defined by the formula:

$$T_S=(T_d*2^n):2$$

Where $T_S$—the code security protecting time, $T_d$—post failure delay time, n—number of bits in the protecting code.

In the preferred embodiment a 16 bit protecting code has been considered. Then, for example for the preferred embodiment:

$$T_S=(45*2^{16}):2=1{,}474{,}560 \text{ sec}=409.6 \text{ hours}=17 \text{ days}.$$

The cited above example shows, that 409 hours in average would be required to detect a 16 bit code pattern of the digitally programmable protective means having 45 seconds of the post failure time delay, by attempting of random trying to match the code possible combinations.

In the preferred embodiment, employing electrical type of the key code sensing means 7, the binary bit sensing contacts 8 are exposed to surrounding open air, and after passing some time the contacts may become dirty or partially oxidized, that potentially can cause deterioration of electrical conductivity between the binary bit sensing contacts 8 and the binary bit coding members 12 of the lock key. In order to prevent potential adverse effect of any kind of contamination of the binary bit sensing contacts, the surface of the cylindrical hub 11*b* key core 11 can be roughened very fine, so every time when the lock key is inserted in the key way 1*a* the roughened surface of the cylindrical hub 11*b* will clean surface of the flexible binary bit sensing contacts 8.

Figure 6A:
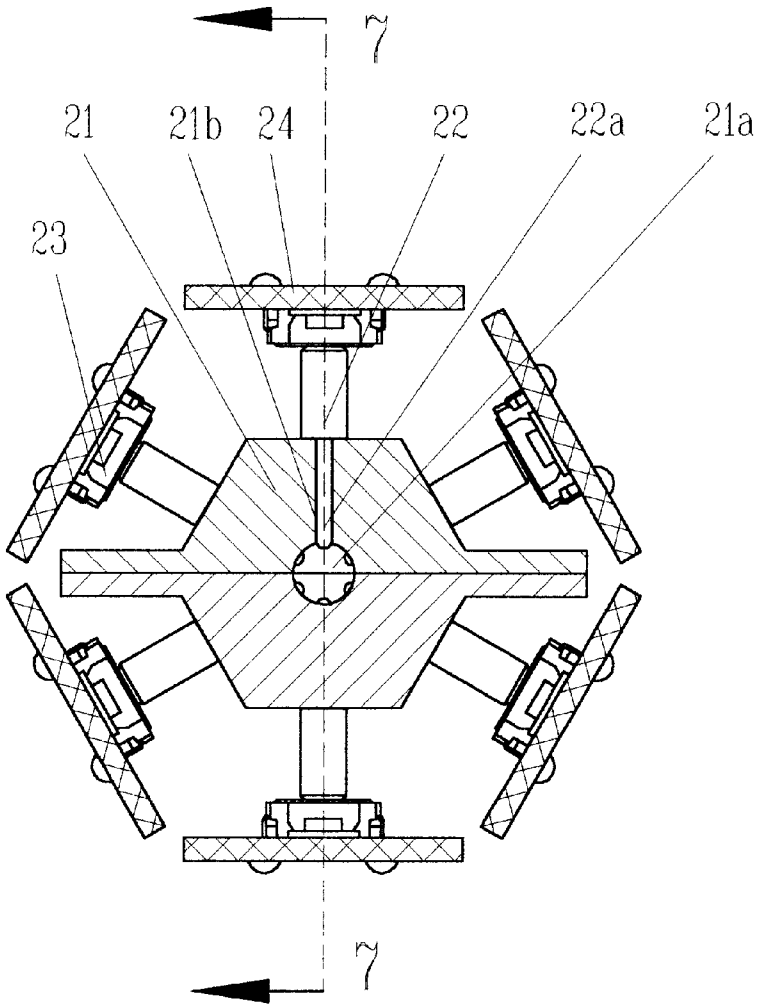
FIG. 6A is a cross-sectional view of the digitally programmable protecting means with mechanical switching type of a key code sensing means, taken along the section 6—6 of FIG. 6.
Figure 6:
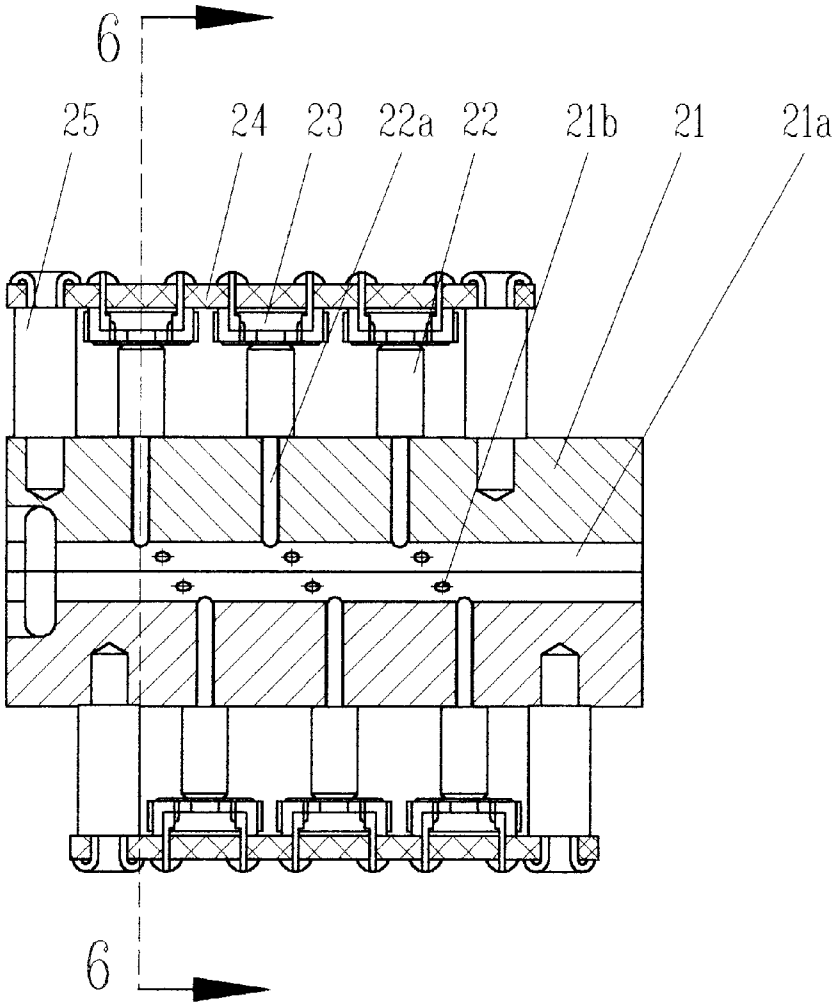
FIG. 6 is a sectional view of the digitally programmable protecting means for a mechanical rotary locking device with mechanical switching type of a key code sensing means in a preferred embodiment (section 7—7 of FIG. 6A)

Referring to FIG. 6 and FIG. 6A a longitudinal and cross sections of a code sensing means with mechanical type of the bit sensing elements are illustrated in a preferred embodiment. The mechanical type of the code sensing means includes a housing 21 with a rotatably born key way 21*a* and radial bit sensing tunnels 21*b*, plurality of code bits sensing plungers 22 comprising binary bit sensing rods 22*a*, a plurality of push-button actuatorless switches 23, a plurality of switch holding means 24 and a plurality of fixing stand-off spacers 25.

In the preferred embodiment the housing 21 is shown composed of two symmetrical components.

For illustration the standard actuatorless ultra low profile push-button keyswitches KSB with normally opened contacts can be considered to be the plurality of push-button switches 23. The switch contact travel of the KSB switch is specified as 0.2 mm (0.008"), and the switch body length is 7.4 mm (0.291").

In the preferred embodiment three switches of the plurality 23 are installed side-by-side on the switch holding means 24, for instance a printed circuit board, composing a switching means assembly.

The housing 21 is shaped in its cross-section as a symmetrical hexagonal prism, each side of the prism is assigned to carry said switching means assembly.

As illustrated in FIG. 6 three radial bit sensing tunnels 21*b* are drilled in each plane of the housing 21 along the central line of the prism's plane, through to the key way 21*a*, forming a series of code bits sensing tunnels. Distances between the tunnels 21*b* are equal to the distances between centers of the switches 23 installed on the switch holding means 24. Said series of code bits sensing tunnels 21*b*, when they are made on two contiguous planes, are longitudinally offset with reference to each other. The magnitude of the longitudinal offset between said series of the bit sensing tunnels, considering that the housing prism in the preferred embodiment has 6 planes, is equal to ⅙ of the distance between the adjacent tunnels on the same plane.

Such arrangement of the tunnels, drilled in all six planes of the housing 21, constitutes a longitudinal sequence of 18 bit sensing tunnels 21*b*, evenly distributed along the key way, and joining the outer planes of the housing 21 and the key way 21*a*.

The cylindrical plunger 22 comprises a thin bit sensing rod 22*a* and a wider switch actuating cylinder, axial with the bit sensing rod 22*a*. The bit sensing rod is terminated with a sphere shape tip. The diameter of the bit sensing rod is slightly smaller then diameter of the bit sensing tunnel 21*b*, so the bit sensing rode 22*a* of the plunger 22 can be freely inserted and slide in the bit sensing tunnel 21*b*. The length of the bit sensing rod 22*a* is such, that when the bit sensing rod is inserted in the bit sensing tunnel 21*b* of the housing 21, the tip of the bit sensing rod will protrude inside the key way 21*a* for a value of not less then the specified switch contacts travel.

The plurality of the sensing plungers 22 are installed in the radial bit sensing tunnels 21*b* of the housing 21. The sensing plungers 22 settle on the external planes of the housing 21, sitting on the step, formed between the bit sensing rode 22*a* and the wider switch actuating cylinder.

The fixing stand-off spacers 25 are installed on each plane of the housing 21, and said switching means assemblies are fixedly installed on the standoff spacers 25, having the push-button switches 23 facing and touching the actuating cylinders of the plungers 22, installed in the bit sensing tunnels 21*b*.

The spherical sensing tips of each bit sensing rod 22*a* protrude in the key way 21*a* to such extent, that when they are pushed to the wall level of the key way 21*a*, the associated switch 23 will be actuated by the plunger 22.

Referring again to FIG. 3, the lock key, when assigned to work with the mechanical type of the code sensing means, will have the bit coding members 12 assorted in two sizes by the outer diameters. Larger diameter of the bit coding member 12 is equal to the diameter of the key core hub 11*b*, so when such a bit coding member is positioned against the sensing tunnel 21*b* the tip of the sensing rod 22*a* will be pushed out to the wall level of the key way 21*a*, and the push-button switch 23 will be actuated by the actuating cylinder of the sensing plunger 22. This represents the bit binary state "0". To represent the bit binary state "1" the bit coding member 12 will have the outer diameter smaller then diameter of the hub 11*b* on the value of double distance of protruding of the tip of the sensing rod 22*a* in the key way 21*a*, so when such a bit coding member 12 is positioned against the bit sensing rod 22*a* the bit sensing rode will not be affected by the bit coding member, and the push-button switch 23 will stay in the initial state of not actuated opened contacts.

The switches 23 are electrically wired and connected to the decoding means 30 in such a way that the opened or closed state of the switches' contacts are functionally equal to the opened or closed states of the sensing contacts of the of electrical type code sensing means, so the binary code structures presented to the decoding means 30 are identical for both types of the code sensing means, and the further functionality of the invention follows the above-stated description.

As many changes can be made to the embodiments without departing from the scope of the invention, it is intended that all material contained herein be interpreted as illustrative of the invention and not in a limiting sense.

The embodiments of the invention in which an exclusive property or privilege is claimed are as follows:

1. A digitally programmable protecting means and a key for a mechanical rotary locking device, said programmable protecting means comprising:

a housing with a key way born rotatably in said housing and at least one communicating opening in said housing arranged from the outer surface of said housing to said key way for communicating to said key when said key is positioned in said key way; a rotatable latchable means operationally attached to said housing at the end of said key way axially aligned with said key way, said rotatable latchable means having a key coupling cavity opened to said key way, rotatably aligned to said key way, an oblong strip attached to said rotatable latchable means for mechanical operating of said mechanical rotary locking device, said rotatable latchable means having at least one latching cavity designated to be engaged in mechanical latching action of said rotatable latchable means; an electromechanical latching means, positioned adjacent to said rotatable latchable means, having a movable mechanical operational member insertable in said latching cavity of said rotatable latchable means for setting a latching state; a key code sensing means, having a plurality of code bit sensing members, said code bit sensing members being exposed to said key way of said housing through said communicating opening in said housing for having direct contact with said key, positioned in said key way; a key code decoding means communicably connected with said key code sensing means and with said electromechanical latching means for verification of the code received from said key code sensing means, and for operating of said electromechanical latching means reflective results of said key code verification;

said key comprising:

a central core with cross-sectional dimension smaller than diameter of said key way, said central core bearing a lock operating tip having shape and size matching said key coupling cavity of said rotatable latchable means for being freely inserted in said key coupling cavity, said central core having a guiding cylindrical hub positioned close to said lock operating tip, said cylindrical hub engaging in pressure contact with at least one said code bit sensing member of said key code sensing means, said cylindrical hub having diameter matching diameter of said key way of said housing for being freely inserted in said key way; a plurality of cylindrical binary bit coding members having axially oriented openings matching the cross-sectional size and shape of said central core and having outer diameters not larger than diameter of said cylindrical hub, said bit coding members are put on said central core of said key for composing a binary code positioned along said central core; a key handle fixedly attached to said central core on the opposite end of said lock operating tip for manual operation of said key.

2. A digitally programmable protecting means and a key in accordance with claim 1 wherein said code bit sensing members of said key code sensing means are a plurality of flexible electrical contacts shaped and sized to be exposed to said key way of said housing through said communicating opening.

3. A digitally programmable protecting means and a key in accordance with claim 2 wherein said communicating opening of said housing is a window longitudinally cut through said housing from its surface to said key way for passing a plurality of said flexible electrical contacts of said key code sensing means to said key way.

4. A digitally programmable protecting means and a key in accordance with claim 3 wherein said bit coding members of said key representing binary code bits of particular binary state are fabricated of electrically conductive material, and said bit coding members representing binary code bits of opposite binary state are fabricated of electrically insulating material.

5. A digitally programmable protecting means and a key in accordance with claim 4 wherein said cylindrical hub of said key has its cylindrical surface, rubbing against said flexible electrical contacts, finely roughened.

6. A digitally programmable protecting means and a key in accordance with claim 1 wherein said code bit sensing means is a plurality of electrical switching means firmly positioned with reference to said housing, said electrical switching means being actuated by key code sensing plungers which are in mechanical communication with said key way of said housing.

7. A digitally programmable protecting means and a key in accordance with claim 6 wherein said communicating opening of said housing is a plurality of through tunnels from surface of said housing to said key way, radial to said key way, for accommodating and guiding of said key code sensing plungers.

8. A digitally programmable protecting means and a key in accordance with claim 7 wherein said key code sensing plungers are positioned inside said through tunnels having their outer end abutting an operable element of said switching means, and their opposite end protruding inside of said key way to the length not less than the length of contacts travel of said switching means.

9. A digitally programmable protecting means and a key in accordance with claim 6 wherein said bit coding members of said key representing binary code bits of particular binary state have their diameter equal to diameter of said cylindrical hub of said key central core, and said bit coding members representing binary code bits of opposite binary state have their diameter smaller than diameter of said cylindrical hub of said key central core on such value, that the difference between diameter of said cylindrical hub and diameter of said bit coding member is not smaller than double length of contacts travel of said electrical switching means.

10. A digitally programmable protecting means and a key in accordance with claim 1 including said key code decoding means, comprising:

a parallel code receiving means for receiving a parallel binary code from said key code sensing means; a plurality of security code pattern setting means; a plurality of Exclusive NOR logic gates with one input of each of said Exclusive NOR logic gates connected to said parallel code receiving means, and another input connected to said security code pattern setting means for comparing of codes from said parallel code receiving means and said security code pattern setting means; a plurality of first set of pull up resistors, for providing initial voltage potentials to said parallel code receiving means; a plurality of second set of pull up resistors for providing initial voltage potentials to said security code pattern setting means; an AND logic gate having its inputs connected to outputs of said Exclusive NOR logic gates for checking the result of comparison of codes from said parallel code receiving means and said security code pattern setting means; a switching semiconductor means connected to said electromechanical latching means for connecting electrical power to said electromechanical latching means, said switching semiconductor means having its operating input connected to output of said AND logic gate; a charge holding capacitor, for accumulating and holding an electrical charge; a charging logic gate, having its input connected to output of said AND logic gate, and its output connected to said charge holding capacitor for charging of said charge holding capacitor when output of said AND logic gate indicates not equality of codes from said code receiving means and said security code pattern setting means; a discharging resistor, for time controlled discharging of said charge holding capacitor; a feedback logic gate, having its input connected to said charge holding capacitor, and its output connected to input of said AND logic gate for disabling of said AND logic gate while said charge holding capacitor holds electrical charge above an operating threshold of said feedback logic gate; a power supply having its prime polarity output permanently connected to the power consuming functional components of said key code decoding means and having its neutral polarity output connected to first power dedicated terminal of said parallel code receiving means; said power consuming functional components of said key code decoding means have their neutral polarity inputs connected together and connected to second power dedicated terminal of said parallel code receiving means, said first and second power dedicated terminals are separately connected to adjacent first and second code bit sensing members of said code sensing means for connecting of said power supply to said key code decoding means when said key is placed in key way of said housing and said cylindrical hub of said key central core engages in pressure contact with said first and second adjacent code bit sensing members, electrically closing them together.

11. A digitally programmable protecting means and a key in accordance with claim 10 wherein said housing is fabricated of electrically conductive material, and said power supply has its neutral polarity output connected to said housing for connecting of said power supply to said key code decoding means when said key is placed in said key way of said housing and said cylindrical hub of said key central core engages in pressure contact with said second power dedicated terminal of said code sensing means and with said housing, electrically closing them together.

* * * * *